US007118001B2

(12) United States Patent
Klein et al.

(10) Patent No.: US 7,118,001 B2
(45) Date of Patent: Oct. 10, 2006

(54) OVER DOOR STORAGE RACK FOR CABINET DOORS

(75) Inventors: Richard B. Klein, Overland Park, KS (US); John W. Scott, Lenexa, KS (US); Chris Serslev, Leawood, KS (US)

(73) Assignee: Lynk, Inc., Lenexa, KS (US)

( * ) Notice: Subject to any disclaimer, the term of this patent is extended or adjusted under 35 U.S.C. 154(b) by 231 days.

(21) Appl. No.: 10/686,847

(22) Filed: Oct. 16, 2003

(65) Prior Publication Data

US 2004/0094494 A1 May 20, 2004

Related U.S. Application Data

(63) Continuation-in-part of application No. 10/279,474, filed on Oct. 24, 2002, now Pat. No. 6,857,528.

(51) Int. Cl.
*A47F 5/08* (2006.01)

(52) U.S. Cl. ..... 211/90.03; 211/119.004

(58) Field of Classification Search ..... 211/90.03, 211/106, 119, 119.009, 119.004, 181.1; 248/214, 248/215

See application file for complete search history.

(56) References Cited

U.S. PATENT DOCUMENTS

| | | | | |
|---|---|---|---|---|
| 1,522,204 | A | | 9/1925 | Bowers |
| 2,459,909 | A | | 1/1949 | Alofs |
| 2,472,058 | A | * | 6/1949 | Artley ..... 211/13.1 |
| 2,633,998 | A | * | 4/1953 | Derman et al. ..... 211/104 |
| 2,972,419 | A | * | 2/1961 | Zelen et al. ..... 211/119.004 |
| 3,918,670 | A | | 11/1975 | Doherty |
| D287,550 | S | | 1/1987 | Tocci |
| D288,282 | S | | 2/1987 | Sheets |
| D305,299 | S | | 1/1990 | Freeman |
| 5,085,389 | A | | 2/1992 | Levesque |
| D354,412 | S | | 1/1995 | Emery |
| 5,433,355 | A | * | 7/1995 | Watkins ..... 223/1 |
| 5,460,279 | A | * | 10/1995 | Emery et al. ..... 211/106 |
| 5,511,750 | A | | 4/1996 | Evenson |
| 5,553,823 | A | * | 9/1996 | Protz, Jr. ..... 248/304 |
| D381,225 | S | | 7/1997 | Malik |
| D385,481 | S | | 10/1997 | Klein et al. |
| D386,668 | S | | 11/1997 | Klein et al. |
| D397,565 | S | | 9/1998 | Klein et al. |
| 5,855,279 | A | | 1/1999 | Klein et al. |
| 5,875,902 | A | * | 3/1999 | Emery et al. ..... 211/90.03 |
| 5,894,940 | A | * | 4/1999 | Gusdorf et al. ..... 211/35 |
| D415,950 | S | | 11/1999 | Anderson |
| 6,152,313 | A | | 11/2000 | Klein et al. |
| 6,581,790 | B1 | * | 6/2003 | Zadro ..... 211/119 |
| 6,857,528 | B1 | * | 2/2005 | Klein et al. ..... 211/119.004 |

* cited by examiner

*Primary Examiner*—David Purol
(74) *Attorney, Agent, or Firm*—Blackwell Sanders Peper Martin, LLP

(57) ABSTRACT

A storage rack which hangs on the upper edge of a base cabinet door. A pair of hanger brackets fit closely on the door edge and are constructed to accommodate the plain edge of a flush mounted door or the stepped edge of a recessed cabinet door. Hooks on the inside parts of the brackets receive mounting fixtures used to attach storage devices such as baskets, trays, shelves, paper towel holders, food wrap dispensers, towel hooks or towel bars. Tabs on the outside parts of the hanger brackets allow a towel bar or other device to be mounted on the outside surface of the base cabinet door. Alternative embodiments provide a single bracket which can be applied to both flush and recessed doors and which accommodates different types of storage devices that may be hooked or otherwise connected to the brackets. The connections between the brackets and storage devices can be made in various ways, including hooks fitting through openings and threaded connections.

16 Claims, 8 Drawing Sheets

OVER DOOR STORAGE RACK FOR CABINET DOORS

RELATED APPLICATIONS

This application is a continuation-in-part of application Ser. No. 10/279,474, filed on Oct. 24, 2002, in the name of Richard B. Klein, et al., which issued on Feb. 22, 2005 as U.S. Pat. No. 6,857,528.

FIELD OF THE INVENTION

This invention relates generally to the storage of household articles on cabinet doors and more particularly to a storage rack that hangs on the door of a cabinet of the type commonly found in residential kitchens and in other areas such as laundry rooms, bathrooms, garages and basement storage areas.

BACKGROUND OF THE INVENTION

Kitchen cabinets are commonly used for the storage of food, tablewares and various household products such as dish towels, bags, soaps, paper towels, food wrap, and cleaning supplies. Other household areas such as bathrooms, basements, laundry rooms and garages are also often provided with cabinets of various types. Because of the variety of items that are typically stored in these cabinets, it is common for the cabinets to become cluttered and disorganized. The hinged doors that open and close cabinets are used at times to hold racks which are permanently fixed to the inside door surface. In some instances, it is undesirable to mar the door with a fastener. Many consumers are unwilling or hesitant to purchase products that require tools to install.

BRIEF SUMMARY OF THE INVENTION

The present invention is directed to a storage rack that hangs on the top edge of a cabinet door and provides for the storage of various articles, including dish towels, dish rags, bags, food wrap, cleaning supplies, dish soap, paper towels and other household articles that can be stored in a basket or tray or on a shelf in a kitchen or other areas. The storage rack hanging system may optionally include a structure for mounting a towel bar on the outside surface of the base cabinet door. The hanger brackets for the storage rack may be provided in two different configurations, one for a flush type cabinet door and the other for a recessed type door. Alternatively, a single bracket can be constructed for application to both flush type and recessed type doors.

It is an object of the invention to provide a cabinet storage rack that hangs securely on the upper edge of a cabinet door to accommodate storage of various articles commonly stored in cabinets. It is a particular feature of the invention in this regard that the storage device can take a number of different forms, including a towel bar, hooks, a basket, a shelf, a tray, a bag holder, a paper towel holder, a food rack dispenser, or another type of storage apparatus.

Another object of the invention is to provide a cabinet storage rack of the character described that may be constructed to accommodate a towel bar on the outside surface of the cabinet door and a storage device for other items on the inside surface of the door.

A further object of the invention is to provide a cabinet storage device of the character described that is applicable both to flush type doors and to recessed type doors. In this respect, the hanger bracket that hangs on the top edge of the cabinet door can have an inverted U-shape to fit closely on a flush type door edge, or it can have a stepped configuration to fit closely on the stepped upper edge of a recessed type door. Alternatively, a single bracket can be constructed in a manner to accommodate both types of doors in different orientations.

Yet another object of the invention is to provide a cabinet storage rack of the character described that is constructed to accommodate the storage of a wide variety of household articles.

A still further object of the invention is to provide a cabinet storage rack of the character described that can be detachably mounted on a cabinet door without permanently damaging any part of the door.

Still another object of the invention is to provide a cabinet storage rack of the character described that has the versatility to be mounted either detachably with a hanger bracket or with a mechanical fastener such as a screw.

An additional object of the invention is to provide a cabinet storage rack of the character described that is constructed in a simple and economical manner, has an aesthetically pleasing appearance, and can be packaged compactly and assembled easily without the need for special skills or tools.

These and other objects of the invention are achieved in one aspect by providing special hanger brackets that hang closely and securely on the upper edge of a cabinet door. Each bracket may have a leg extending downwardly along the inside door surface. A hook or other structure may be formed on the lower end of each leg to receive a mounting fixture to which a basket or other storage device may be attached.

The brackets may also present tabs or another structure on the outside of the door for the receipt of mounting fixtures for a towel bar. The towel bar may fit in sockets in the mounting fixtures to extend between them, thus mounting the towel bar at a convenient location on the outside of the door.

One embodiment of the invention provides a single bracket that is constructed to accommodate both flush type cabinet doors and recessed type doors. The bracket may have an L shaped hanger on one end to fit closely on the upper edge of a flush type door. The other end of the bracket may have a C shaped hanger that can be applied closely to the upstanding lip on the top edge of a recessed type door. The arrangement has the advantages of simplicity and economy in that a single bracket has the versatility to be applicable to both types of cabinet doors.

Another aspect of the invention that is advantageous is the technique that can be used to attach the storage rack or other storage device to the hanger brackets in a simple and economical construction. The brackets may have openings for receiving hooks on the ends of hanger rods or other hangers that carry the storage device. Optionally, screws or other mechanical fasteners can be applied through the hooks and threaded into the inside of the cabinet door without the need to use brackets.

The storage device may take various forms, including wire baskets and other structures for holding household items and other articles. In one form of the invention, the storage device includes a vertical rod on which a roll of paper towels may be received in a vertical position such that the towels can be easily drawn off the roll. A basket for holding household cleaning products may be located directly beside the paper towel holder for convenient access for use with towels dispensed from the roll.

BRIEF DESCRIPTION OF THE SEVERAL VIEWS OF THE DRAWING

In the accompanying drawings which form a part of the specification and are to be read in conjunction therewith and in which like reference numerals are used to indicate like parts in the various views.

DETAILED DESCRIPTION OF THE INVENTION

Figure 1:
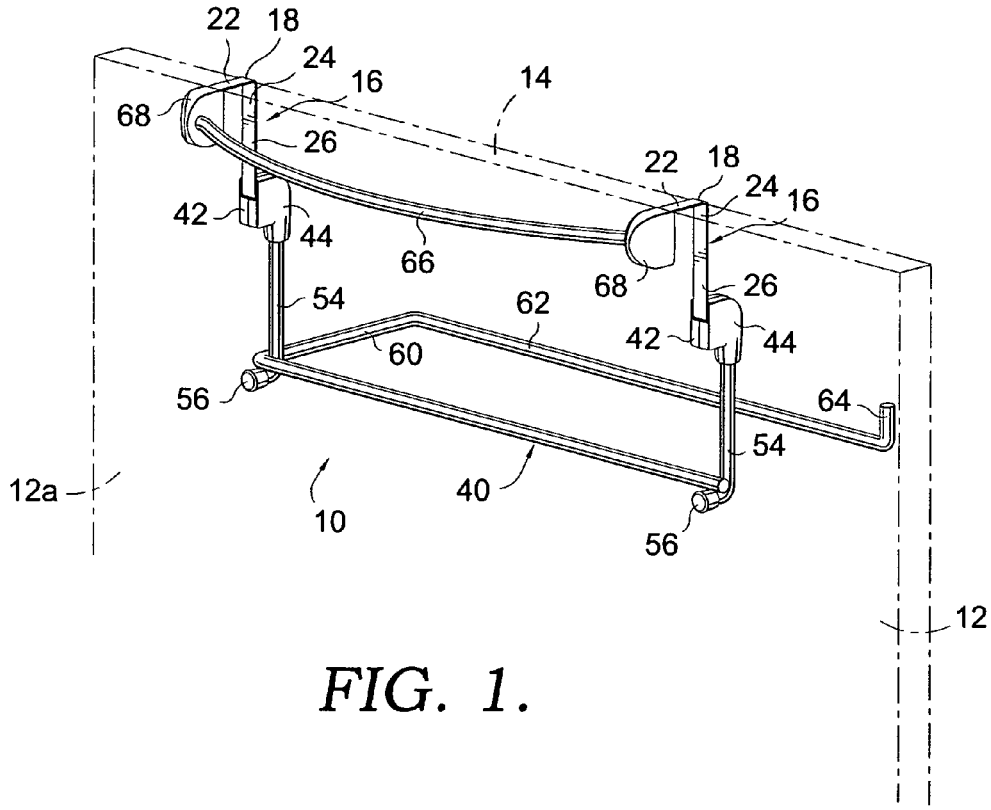
FIG. 1 is a perspective view of a storage rack constructed according to one embodiment of the present invention applied to a flush type cabinet door which is shown in broken lines.

Referring now to the drawings in more detail and initially to FIGS. 1–4 in particular, numeral 10 generally designates a storage rack constructed according to one embodiment of the present invention. As best shown in FIG. 1, the storage rack 10 may be mounted on a cabinet door 12 and, more specifically, may be hung on an upper edge 14 of the door 12. The door 12 is typically hinged to the cabinet facing and may be swung to open and close a cabinet such as a base cabinet of the type commonly found in kitchens beneath a counter top 15 (FIG. 7), or above the countertop or at another location. The door 12 has a flat upper edge and is commonly referred to as a flush type cabinet door. The storage rack of the present invention may be used with base cabinets and with other types of cabinets in various rooms, including, for example, laundry rooms, bathrooms, garages and basements.

Figure 2:
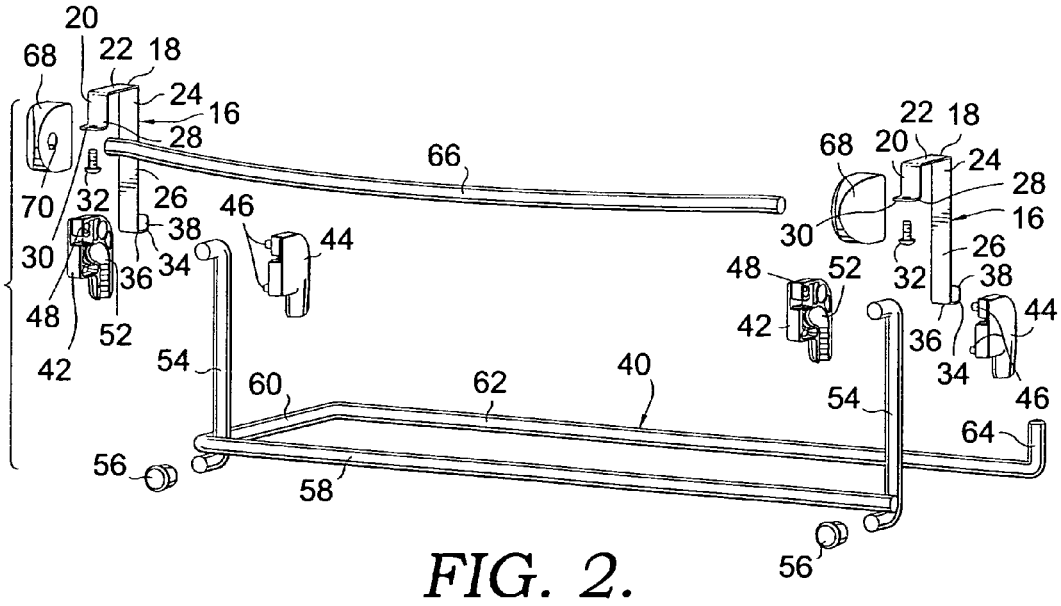
FIG. 2 is an exploded perspective view of a storage rack shown in FIG. 1.
Figure 3:
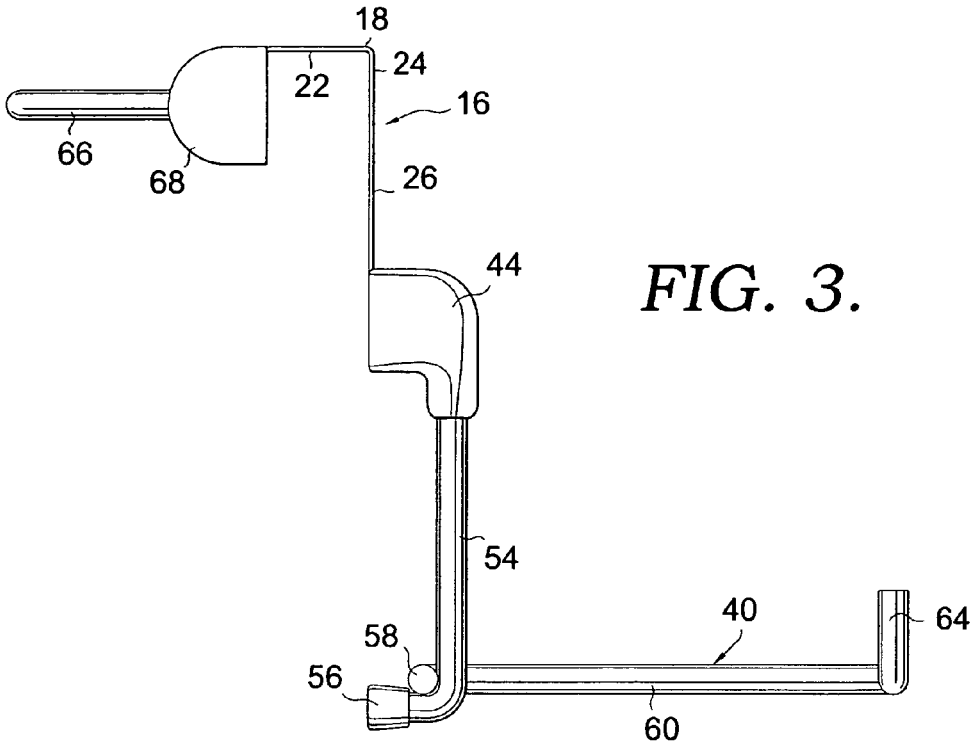
FIG. 3 is a side elevational view on an enlarged scale of the storage rack shown in FIG. 1.
Figure 7:
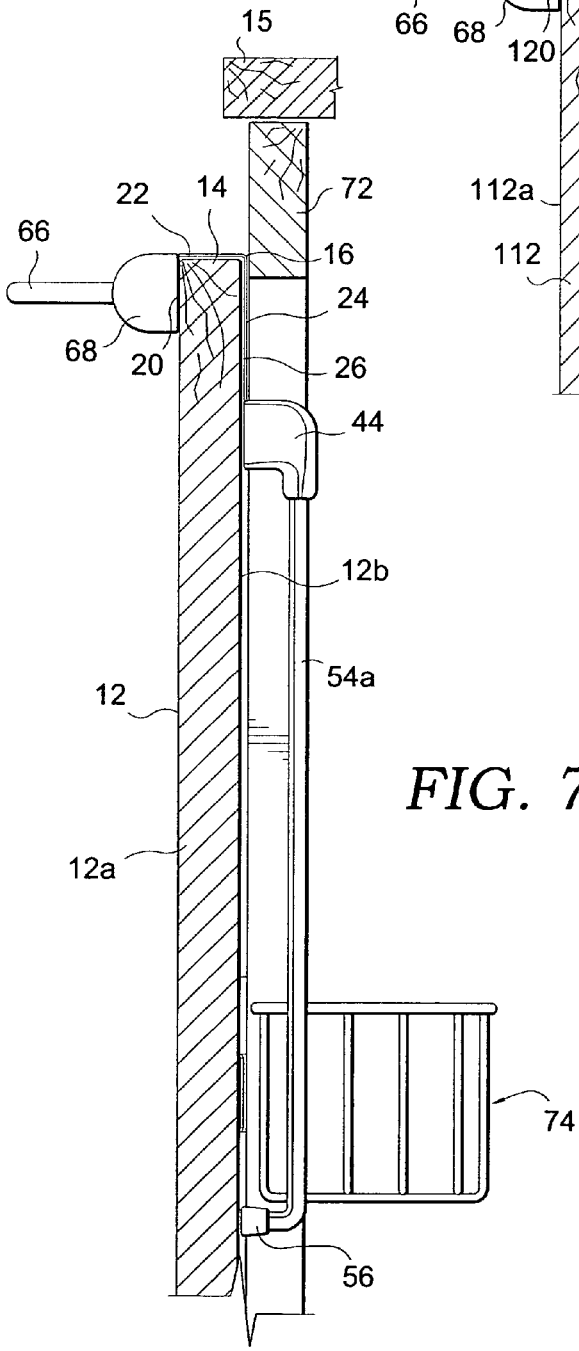
FIG. 7 is a fragmentary side elevational view showing a storage rack constructed according to another embodiment of the invention mounted on a flush type cabinet door and providing a basket for the storage of articles.

The storage rack 10 includes a pair of hanger brackets which are identical to one another and generally identified by numeral 16. As best shown in FIG. 2, each of the hanger brackets 16 has a hanger portion 18 that hangs on the upper door edge 14. The hanger portion 18 has the shape of an inverted U and includes a vertical front strip 20, a horizontal flange 22 extending rearwardly from the upper edge of the front strip 20, and a back strip 24 extending downwardly from the back edge of the flange 22. A vertical leg 26 extends downwardly from the rear strip 24 and forms a downward continuation of the strip 24. As best shown in FIG. 7, each bracket 16 may be applied to the upper edge 14 of door 12 and fits closely on the upper edge of the door with the flange 22 spanning the edge 14 and fitting closely on it and the front and back strips 20 and 24 located adjacent to the outside and inside surfaces 12*a* and 12*b*, respectively, of the door 12.

With particular reference to FIG. 2, each bracket 20 may include a horizontal tab 28 which projects forwardly from the lower edge of the front strip 20 and may be provided with an opening 30 for receiving a screw 32. The lower edge of the leg 26 is provided with a hook 34. Each hook 34 includes a horizontal tongue 36 which extends rearwardly from the bottom edge of leg 26 and a vertical lip 38 which extends upwardly from the back edge of the tongue 36.

Figure 4:
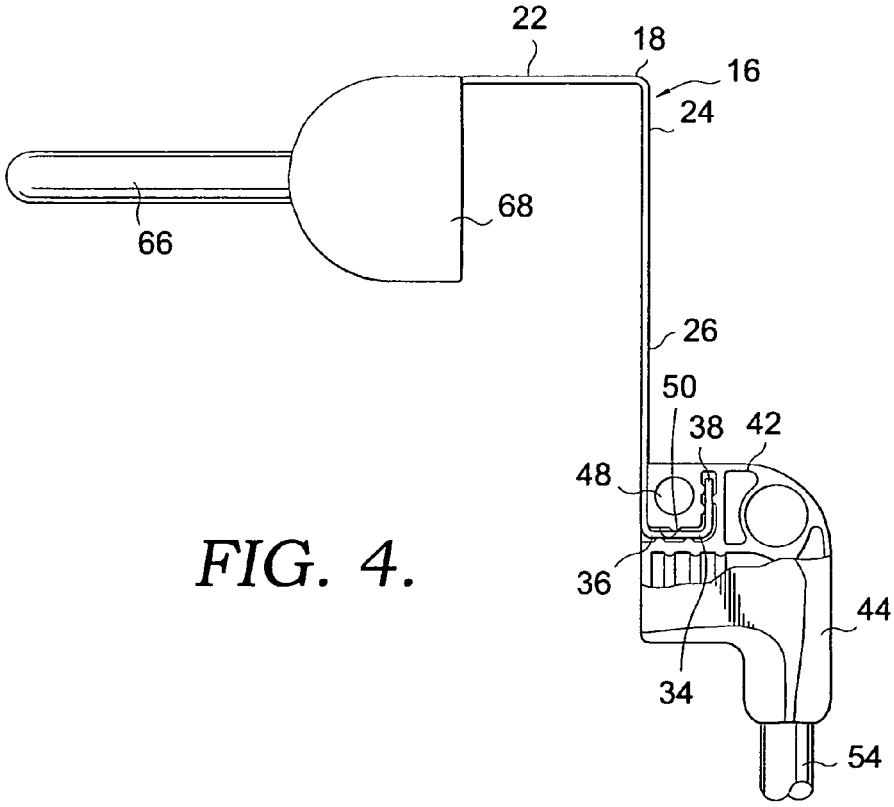
FIG. 4 is a fragmentary side elevational view of the storage rack shown in FIG. 3 on an enlarged scale with a portion of the mounting fixture broken away to illustrate the internal details.

The hooks 34 provide inner connection portions that allow various types of storage devices to be connected to the brackets 16. By way of example, a paper towel holder generally identified by numeral 40 may be connected to the brackets 16. Each bracket 16 may mount a two-piece block structure that includes a pair of mating fixtures 42 and 44. The fixtures 42 and 44 may be fitted and secured together with pins 46 projecting from fixture 44 fitting in mating sockets 48 formed in the other fixture 42 to assure alignment. The fixtures 42 and 44 may be screwed together or connected in any other suitable fashion. Alternatively, the fixtures 42 and 44 may be formed as a single unitary piece. As best shown in FIG. 4, the mating fixtures 42 and 44 cooperate to present an L-shaped passage 50 that closely receives the tongue 36 and lip 38 of hook 34 in order to secure the fixtures in place on the lower ends of the bracket legs 26. The fixtures 42 and 44 also cooperate to present an L-shaped cavity 52 (FIG. 2) in each pair of fixtures. The cavities 52 closely receive the L-shaped upper ends of generally vertical braces 54 that form parts of the paper towel holder 40. Each brace 54 has a bent upper end that fits in the cavity 52 and a bent lower end that receives a cushioned foot 56. The feet 56 fit against the inside surface 12*b* door 12, as do flat cushioned surfaces of the fixtures 42 and 44. This braces the storage rack securely against the inside surface of the door 12 while at the same time avoiding scratching or otherwise marring the door.

The paper towel holder 40 further includes a front rod 52 that extends rigidly between the two braces 54 adjacent to their lower bent ends. A short rod 60 extends rearwardly from one end of rod 58 in order to mount a horizontal rod 62 that serves to receive a roll of paper towels (not shown). The opposite end of rod 62 is provided with an upturned pin 64 that prevents the paper towel roll from inadvertently sliding off rod 62.

In this fashion, the paper towel holder 40 provides a convenient location for holding a roll of paper towels on the rod 62 at a location inside of the base cabinet near the inside surface of the door 12 and near the upper edge 14 of door 12 so that the paper towels can be easily reached by a user. Alternatively, the rod or bar that holds the paper towel roll may be oriented vertically and may be provide along with a basket or other storage device on the inside of the door 12, as will be explained more fully.

The tabs 28 (if present) provide outside connection portions that may be used to mount a towel bar 66 on the outside surface of the door 12. A pair of blocks 68 are provided with sockets 70 for receiving the opposite ends of the towel bar 66 in order to locate the towel bar in extension between the blocks 68. The blocks 68 in turn may be secured to the tabs 28 by extending the screws 32 upwardly through the tab openings 30 and threading the screws into the undersides of the blocks 68. In this manner, the towel bar 66 may be mounted on the outside of door 12 near its upper edge where a towel that is stored on it may be conveniently reached. The towel bar 66 may be bowed such that its center portion is located farther away from the outside surface of door 12 than the end portions of the towel bar. It should also be noted that the towel bar can be secured to the connecting portions provided by the tabs 28 in ways other than as disclosed for the preferred embodiment. Further, the tabs 28 can be eliminated in some applications in which there is no desire to provide a towel bar on the outside of the cabinet door 12.

As best shown in FIG. 7, the hanger brackets 16 are used with a flush type door 12 which has a flat, horizontal upper edge 14 that fits flush against the base cabinet facing 72 when the door is closed as shown in FIG. 7.

FIG. 7 also shows an alternative storage device on the inside of the cabinet which takes the form of a wire basket 74. The basket 74 may be secured to braces 54*a* which may be similar to braces 54 and may connect with the fixtures 42 and 44 and may fit against the inside cabinet door surface 12*b* in the same manner described previously in connection with the paper towel holder 40. However, the braces 54*a* may be longer than braces 54 in order to locate the basket 74 at a lower position on the door closer to the cabinet floor.

The paper towel holder 40 and the basket 74 are only exemplary of the types of storage devices that can be mounted on the base cabinet door 12 in accordance with the present invention. Other examples of storage devices that can be provided include trays, shelves, paper or plastic bag holders and racks that hold articles such as dish rags and dish towels. Further, the storage device on the inside of the cabinet door may take the form of a simple hook for holding a towel or the like, and the hook may constitute either a hook similar to the hook 34 (FIG. 2) or another type of hook that is secured to hook 34 or some other connection device provided on the bracket 16 inside of the cabinet door.

Figure 6:
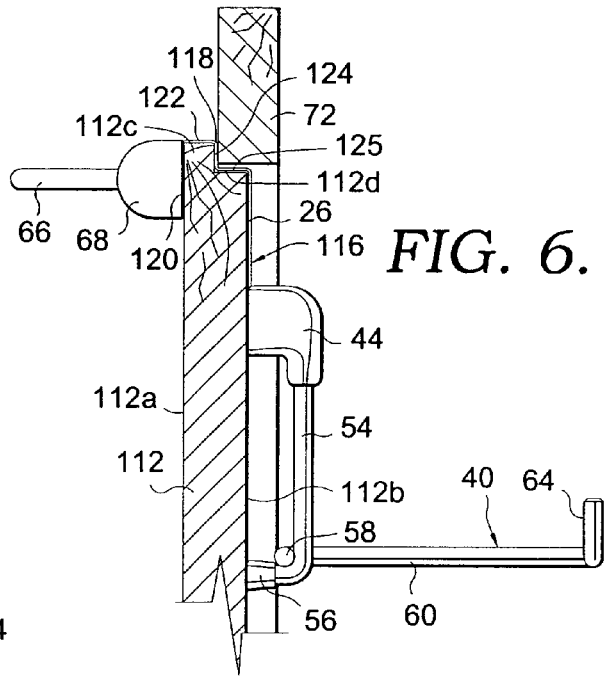
FIG. 6 is a fragmentary side elevational view showing the storage rack of FIG. 5 mounted on a recessed type cabinet door.

FIG. 6 depicts an alternative embodiment of the present invention which may be constructed identically to the embodiment previously described for the most part. However, the embodiment shown in FIG. 6 includes hanger brackets 116 that are somewhat different from the brackets 16 in order to accommodate application of the storage rack to a recessed type cabinet door. As shown in FIG. 6, a recessed type cabinet door 112 has outside and inside surfaces 112*a* and 112*b*, respectively and a stepped upper edge that includes a lip 112*c* adjacent to the outside door surface 112*a* and a horizontal ledge 112*d* that extends rearwardly from the bottom of the lip 112*c* to the upper edge of the inside door surface 112*b*.

Figure 5:
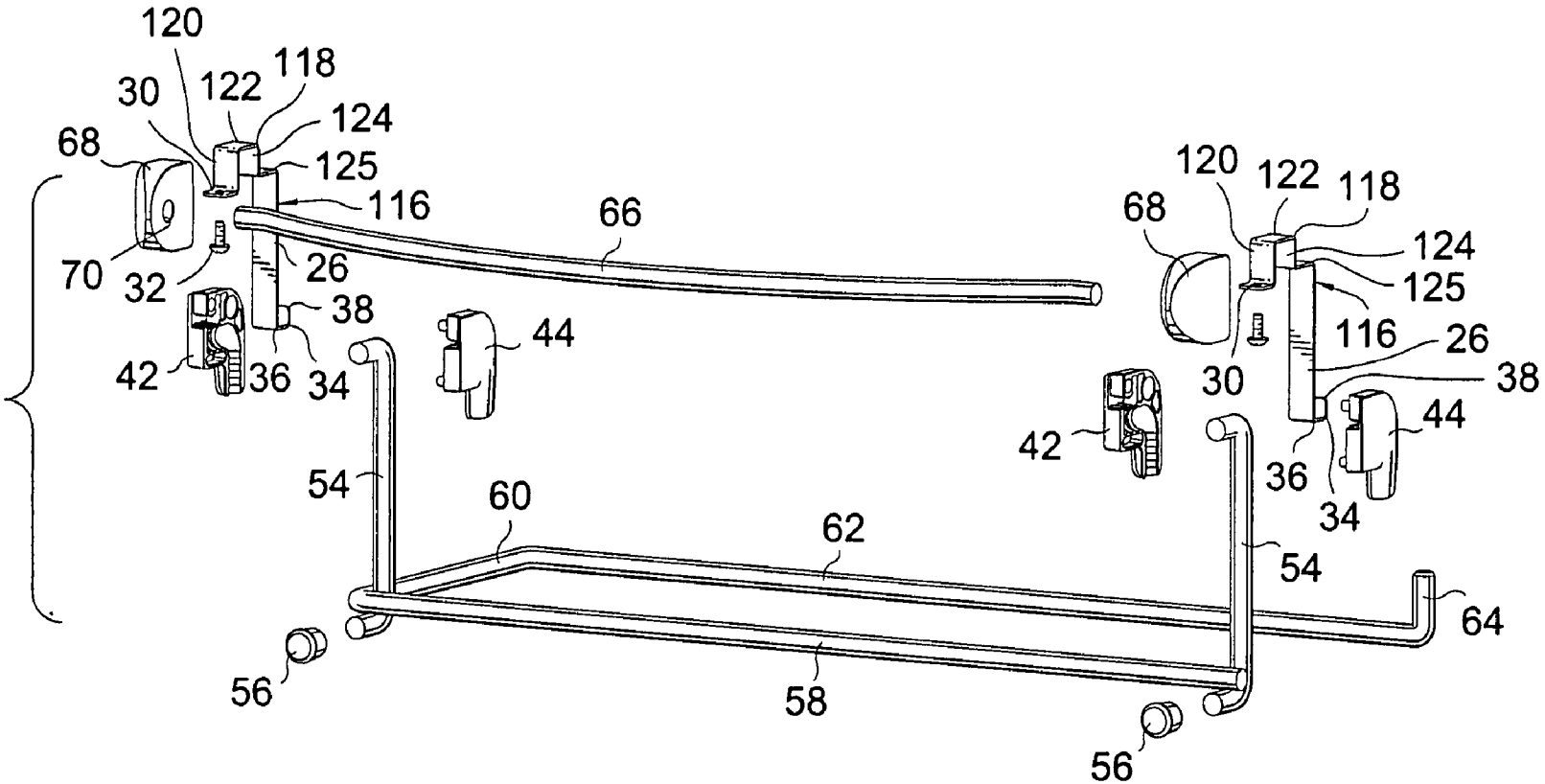
FIG. 5 is an exploded perspective view similar to FIG. 2 but showing hanger brackets constructed according to a modified embodiment of the invention for application to a recessed type cabinet door.

The brackets 116 are shaped to accommodate the stepped upper edge configuration of the recessed type cabinet door 112. Accordingly, each bracket 116 has a hanger portion 118 that is in the shape of an inverted U but in which the flange 122 has a length to barely span the thickness of the lip 112*c*. The front strip 120 of the hanger portion 118 fits closely against the front surface of the lip 112*c*, and the back strip 124 fits closely against the back or inside surface of the lip 112*c*. Each bracket 116 has a horizontal shoulder 125 that is located adjacent to and on top of the ledge 112*d* when the bracket 116 is applied to the door 112. Bracket 116 has a tab 28 and a leg 26 and hook 34 that may be identical to the corresponding components of bracket 16 (see FIG. 5).

The storage rack making use of the brackets 116 is applied closely to the stepped upper edge of a recessed type door 112 in the manner shown in FIG. 6 and otherwise functions identically to the brackets 16 to mount various types of storage devices on the inside and/or outside of the cabinet door 112. As with brackets 16, various types of storage devices can be mounted on the brackets 116.

Figure 8:
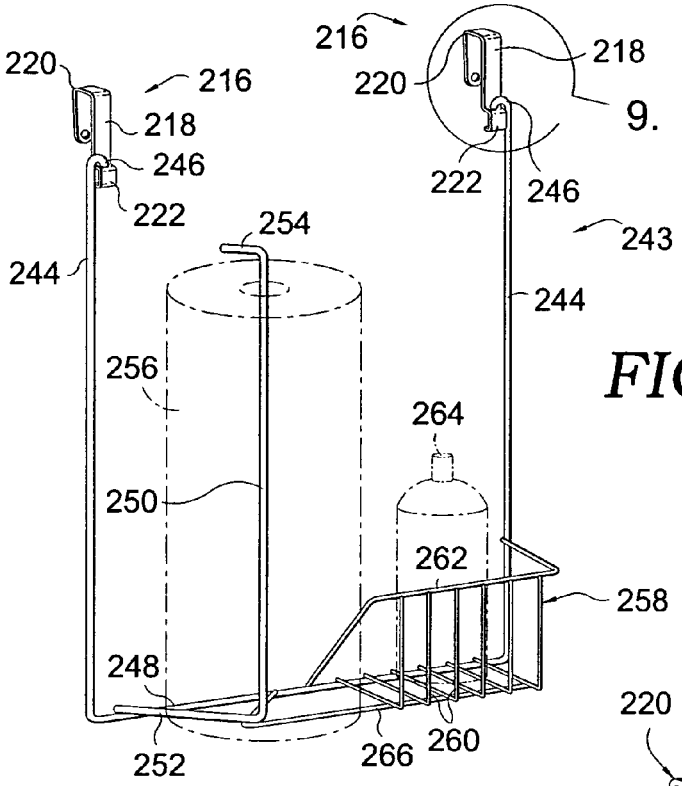
FIG. 8 is a perspective view of a storage rack constructed to still another modified embodiment of the invention, with a roll of paper towels and a household cleaning product shown in broken lines.
Figure 10:
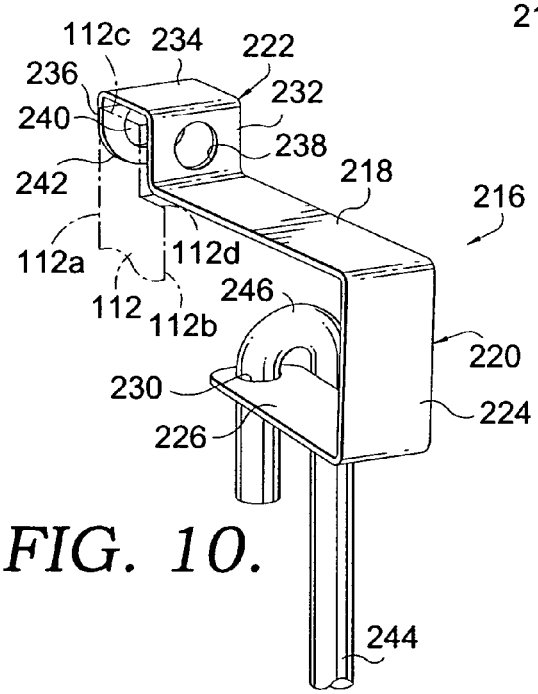
FIG. 10 is a fragmentary perspective view similar to FIG. 9, but showing the hanger bracket applied to the upper edge portion of a recessed type door shown in broken lines.
Figure 9:
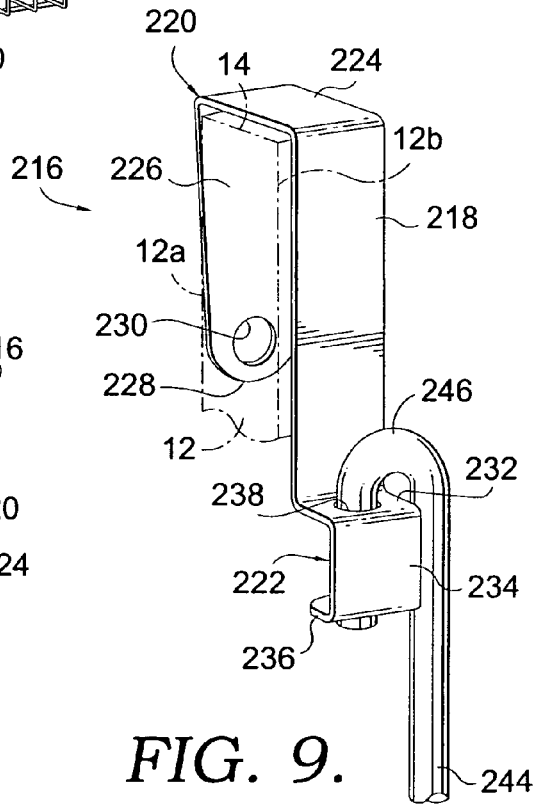
FIG. 9 is a fragmentary perspective view on an enlarged scale of the detail indicated by numeral 9 in FIG. 8.

FIGS. 8–10 illustrate another embodiment of the invention that makes use of a pair of hanger brackets generally identified by numeral 216. Each of the brackets 216 is constructed identically and has a main body formed by a flat leg 218. The leg 218 has opposite ends, one of which connects with an L shaped hanger 220 and the other of which connects with a C shaped hanger 222. The L shaped hanger 220 includes a flange 224 that may have a length slighter greater than the thickness of the upper edge 14 of a flush type door 12. The flange 224 extends from one end of the leg 218. Each hanger 220 further includes a flat tongue 226 which extends generally parallel to the leg 218 from one edge of flange 224. Tongue 226 and leg 218 may converge slightly as they extend away from flange 224 in order to provide a pinching action on the cabinet door. The free end of tongue 226 is preferably rounded at 228 to avoid presenting a sharp edge. The free end portion of tongue 226 may be bent outwardly to avoid marring the door when the bracket is placed over the door. An opening 230 is formed through the tongue 226 near the rounded edge 228.

The C shaped hanger 222 includes a flat arm 232 which extends from the end of leg 218. The arm 232 is parallel to the flange 224 of the L shaped hanger 220. The C shaped hanger 222 also includes a flat flange 234 which extends from one end of arm 232 and is substantially parallel to the leg 218. A tab 236 of the C shaped hanger 222 extends from one end of the flange 234. The tab 236 is parallel to arm 232 and is spaced from the arm a distance slightly greater than the width of the lip 112*c* of a recessed type door 112. Arm 232 is provided with a round opening 238 that is aligned with and the same size as an opening 240 (FIG. 10) formed through the tab 236. The tab 236 preferably terminates in a rounded edge 242.

The storage rack shown in FIGS. 8–10 includes a storage device 243 that is mounted on a pair of vertical hanger rods 244 or other hangers such as flat strips. Each rod 244 is provided at its top end with a hook 246 which may be hooked through openings 238 and 240 or, alternatively, through opening 230 as will be explained more fully. The rods 244 are connected at their lower ends by a horizontal rod 248. The storage device 243 includes a paper towel holder that is formed by a vertical rod 250. The lower end of rod 250 connects with a horizontal arm 252 that is suitably secured to the cross rod 248. The upper end of rod 250 is provided with a horizontal finger 254. A roll 256 of paper towels can be applied to the vertical rod 250 with the roll 256 oriented vertically on the storage device 243. The finger 254 assists in retaining the roll 256 on rod 250.

The storage device 243 further includes a basket 258 which is constructed of a plurality of wires 260 that extend horizontally along the lower portion of the basket 258 and vertically from the horizontal wires to a rim wire 262. The ends of the horizontal portions of wires 260 are secured to the cross rod 248, as is one end of the rim wire 262. The rim wire also connects at one end with one of the hanger rods 244 such that an opening is provided in the top of the basket 258 to receive one or more containers 264 or other items which may be containers for cleaning products or other household products. The basket 258 is supported on a bent rod 266 which is secured to the basket near the lower ends of the vertical wires 260 and also connects with the lower end of rod 250 and then extends to connection with the cross rod 248. The basket 258 is conveniently located to one side of rod 250 next to the paper towel roll 256.

As shown in FIG. 9 in particular, the brackets 216 can be applied to the upper edge 14 of a flush type door 12 by hanging the L shaped hangers 220 on the upper edge 14 with the tongue 226 closely fitting against the outside surface 12*a* of the door and the leg 218 closely fitting against the inside surface 12*b* of the door. The flange 224 rests on top of the upper edge 14 and spans the thickness of the door.

When the hanger brackets 216 are used in this fashion, the C shaped hangers 222 provide projections on the inside of the door for connection of the storage device 243 (FIG. 8). The hooks 246 on the upper ends of the rods 244 can be extended through the openings 238 and 240 (FIG. 10) of the C shaped hangers 222, thus hanging the storage device 243 from the brackets 216 adjacent to the inside surface 12*b* of the door 12.

Alternatively, the brackets 216 can be applied to a recessed type door 112 in the manner shown in FIG. 10. The C shaped hanger 222 is applied to the lip 112*c* with the tab 236 against the outside surface of the lip and the arm 232 against the inside surface of the lip. The flange 234 rests on and spans the upper edge of the lip. A portion of the leg 218 adjacent to arm 232 rests flatly on the ledge 112*d* to assist in stabilizing the brackets 218 on the upper edge of the recessed type door 112.

In this configuration, the L shaped hangers 220 provide projections in the inside of the door for holding the storage device 243. The hooks 246 can be inserted through the openings 230 to hang the rods 244 and the entire storage device 243 from the brackets 216. The tongue 226 preferably has a length such that its rounded edge 228 (FIG. 9) is located close to the inside surface 112*b* of the recessed type door so that the storage rack is located adjacent to the inside surface of the door. In this manner, each of the brackets 216 is able to accommodate both flush type doors 12 and recessed type doors 112 while locating the storage device 243 conveniently inside of the cabinet against the inside surface of the door. The paper towel roll 256 and the container 264 or other items held by the storage device are conveniently accessible at this location.

Figure 11:
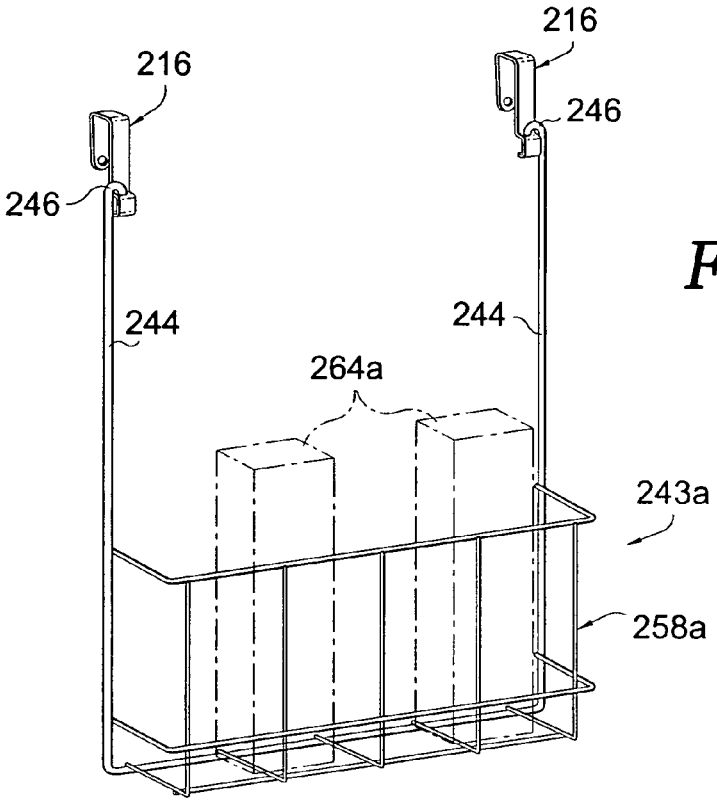
FIG. 11 is a perspective view of a storage rack having a wire basket carried on the bottom ends of hanger rods.

FIG. 11 depicts an embodiment in which the brackets 216 are used with a storage device 243*a* that mounts in the same manner as the storage device 243. The storage device 243*a* includes a relatively large basket 258*a* that is secured to the lower ends of the hanger rods 244 and may receive items such as boxes 264*a* that hold items such as food wraps, plastic wrap, bags, foil and/or wax paper.

Figure 12:
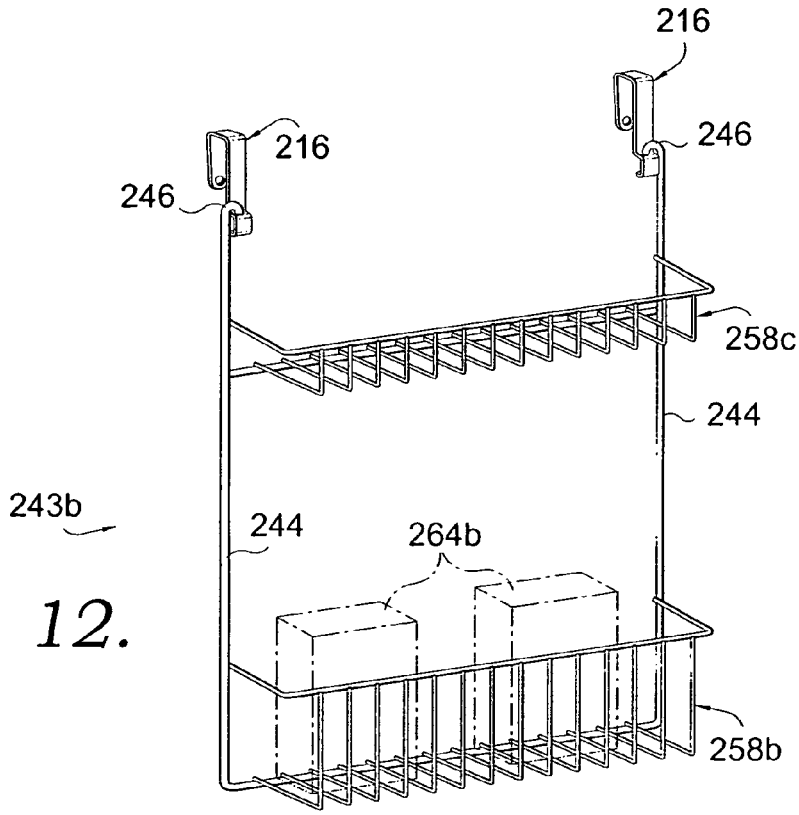
FIG. 12 is a perspective view of a storage rack having a upper and lower baskets on hanger rods.

The embodiment shown in FIG. 12 makes use of the brackets 216 to mount a storage device 243*b* that includes a pair of baskets 258*b* and 258*c*. Basket 258*b* is secured to the lower ends of the hanger rods 244 and is relatively deep compared to the upper basket 258*c* which is located a short distance downwardly from the hooks 246. The lower basket 258 may be constructed to closely receive boxes 264*b* or other containers that hold products such as dish soap. The upper basket 258*c* is a shallower basket that can conveniently hold household cleaning implements such as sponges, dish rags and the like.

Figure 15:
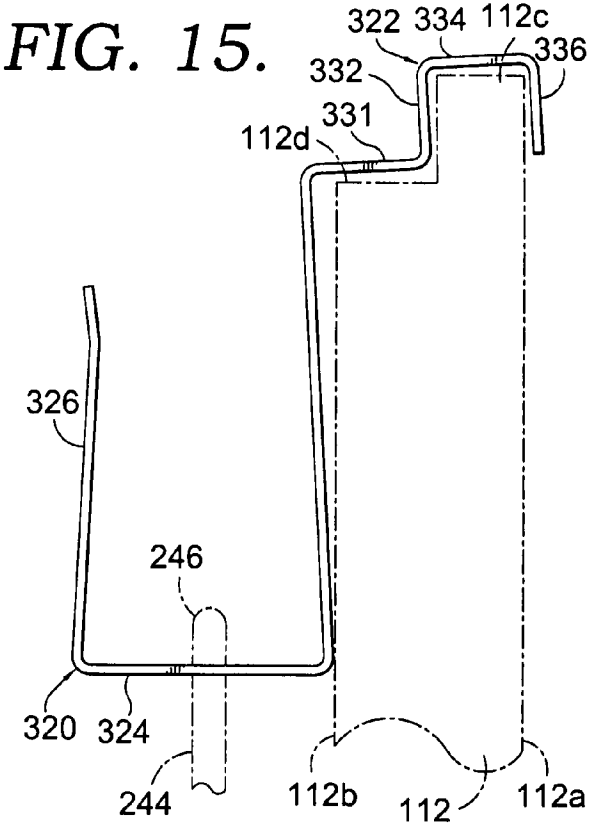
FIG. 15 is an elevational view of the bracket shown in FIG. 13 applied to a recessed type door with the broken lines showing the door and a hanger rod fragmentarily.
Figure 14:
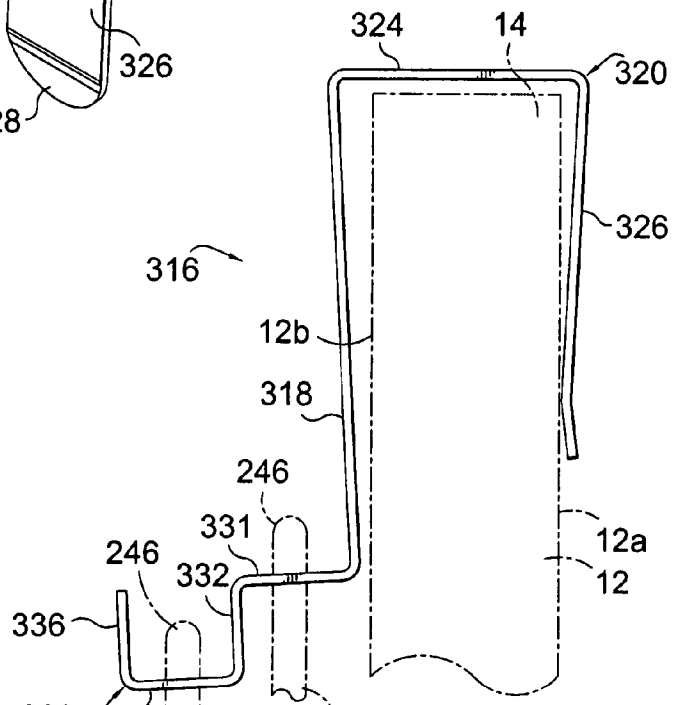
FIG. 14 is an elevational view of the bracket shown in FIG. 13 applied to a flush type door with the broken lines showing the door and hangers fragmentarily.
Figure 13:
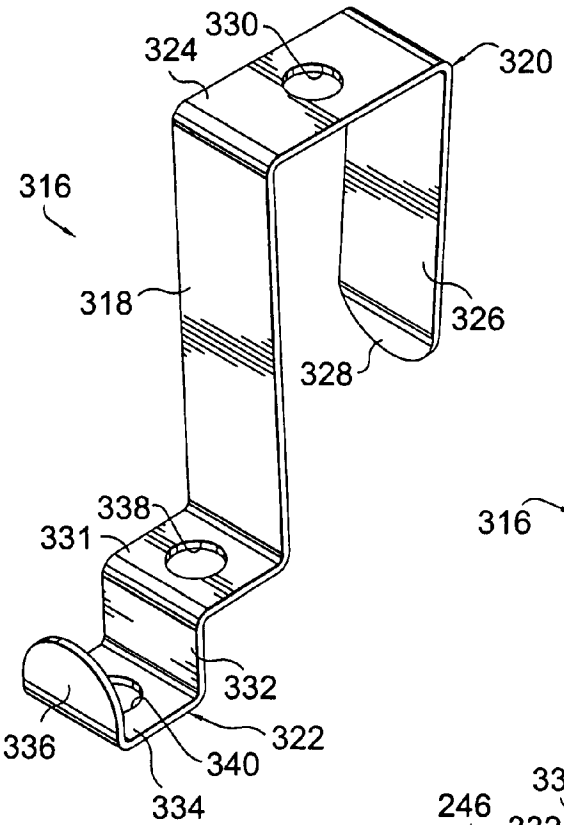
FIG. 13 is a perspective view of a cabinet hanger bracket constructed in accordance with a further embodiment of the invention.

FIGS. 13–15 depict an alternative hanger bracket that is generally identified by numeral 316. The bracket 316 is similar to but slightly different from bracket 216 and is constructed to mount a storage rack on either a flush type door 12 or a recessed type door 112. Bracket 316 has a main body which is formed by a flat leg 318 having an L shaped hanger 320 on one end and a C shaped hanger 322 on the other end. The L shaped hanger 320 includes a flat flange 324 which extends from one end of leg 318 and is generally perpendicular to the leg. The L shaped hanger 320 further includes a tongue 326 which extends from one end of the flange 324 and is generally parallel to the leg 318. The tongue 326 may converge slightly relative to the leg 318 as it extends away from flange 324 to apply pressure for holding of the bracket 316 on a flush type door. The lower end of the tongue 326 is preferably rounded as indicated at 328. The flange 324 is provided with a round opening 330.

The C shaped hanger 322 is connected with one end of leg 318 by a flat shoulder 331 which is generally perpendicular to leg 318. The C shaped hanger includes an arm 332 which extends from one end of shoulder 331. A flat flange 334 extends from the opposite end of arm 332 and is parallel to the shoulder 331. A tab 336 extends from flange 334 and is parallel to arm 332. The distance between the arm 332 and the tab 336 is slightly greater than the thickness of the lip 112*c* on the upper end of a recessed type door 112. The shoulder 331 is provided with a round opening 338. Flange 322 is also provided with a round opening 340.

Bracket 316 is used with an identical bracket to support a storage rack on a base cabinet door which may be either a flush type door 12 or a recessed type door 112. Each bracket 316 is applied to a flush type door 12 in the manner shown in FIG. 14. The L shaped hanger 320 is applied to the upper edge 14 of door 12 with the tongue 326 against the outside door surface 12*a* and the leg 318 against the inside door surface 12*b*. The flange 324 spans and rests on the upper edge 14 of the door.

The C shaped hanger 322 and the shoulder 331 provide a projection from which a storage device may be suspended. The storage device may be of virtually any type, including the types of devices previously described. As shown in FIGS. 13 and 14, the hook 246 of rod 244 may be hooked in either of the openings 338 or 340, depending upon how close to the inside surface 12*b* the storage device is to be located in the particular application that is involved. The provision of both openings 338 and 340 provides flexibility as to the location of the storage rack that is suspended from bracket 316.

FIG. 15 shows bracket 316 applied to the upper edge of a recessed type door 112 such that the C shaped hanger 322 is applied to the lip 112*c* with the tab 336 lying closely against the outside door surface 112*a* and the arm 332 fitting closely against the inside surface of the lip 112*c*. The flange 334 spans the upper edge of the lip, and the shoulder 331 lies flatly on the ledge 112*d*. The leg 318 (FIG. 14) extends downwardly along the inside door surface 112*b*. When the bracket 316 is applied to a recessed door, the L shaped hanger 320 provides a projection to which a storage device of virtually any type can be connected. The hook 246 can be inserted through the opening 330 (FIG. 3) in order to suspend the hanger rods 244 and the storage devices they carry from the brackets 316.

Figure 16:
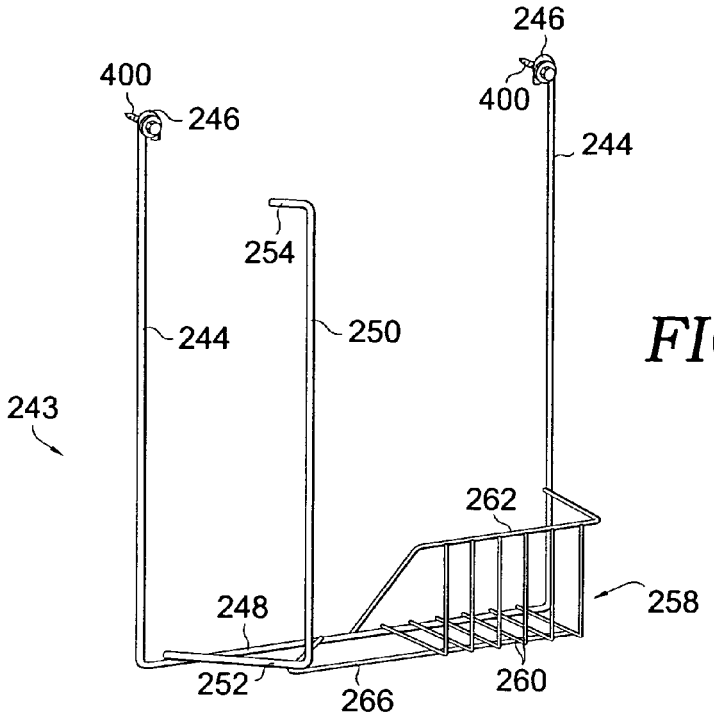
FIG. 16 is a perspective view of a storage rack connected with screw fasteners to the inside surface of a cabinet door in accordance with another embodiment of the invention.

Referring now to FIG. 16, the storage device 243 (and other types of storage devices) can be secured to the inside surface of a flush type cabinet door or a recessed type cabinet door by mechanical fasteners so that the hanger brackets 216 are not necessary. The hooks 246 provide eyes within them that can receive fasteners such as the screws 400 shown in FIG. 16 inserted through the hooks 246 and threaded into the inside surface of a cabinet door. The hooks 246 thus serve the dual purpose of allowing storage device 243 (or another storage device) to be hung on hanger brackets for detachable connection to a cabinet door, or to be more permanently mounted through use of fasteners such as screws 400.

While in some applications, the use of mechanical fasteners is desirable, there are other applications where detachable mounting of the storage rack is necessary or desirable. For example, apartment residents normally are not authorized to permanently mar cabinet doors with screws or other fasteners. Many consumers are hesitant to install things that require the use of tools. Consequently, the provision of a cabinet door storage device having the versatility to be detachably mounted with hanger brackets or, alternatively, more permanently mounted with mechanical fasteners, is a highly desirable feature of the invention.

While the provision of hooks fitting in bracket openings results in a simple and economical way to connect the storage device with the brackets, other connection methods can be used, including screw connections, clip connections, peg hook connections, welds or other types of permanent connections, and various additional types of connections.

Figure 18:
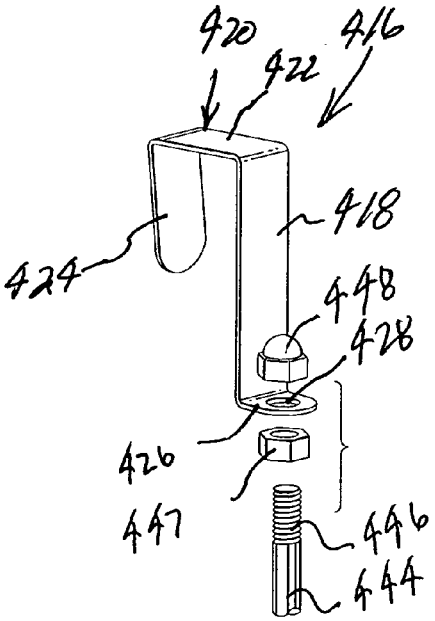
FIG. 18 is a fragmentary exploded perspective view on an enlarge scale of the detail identified by numeral 18 in FIG. 17.
Figure 17:
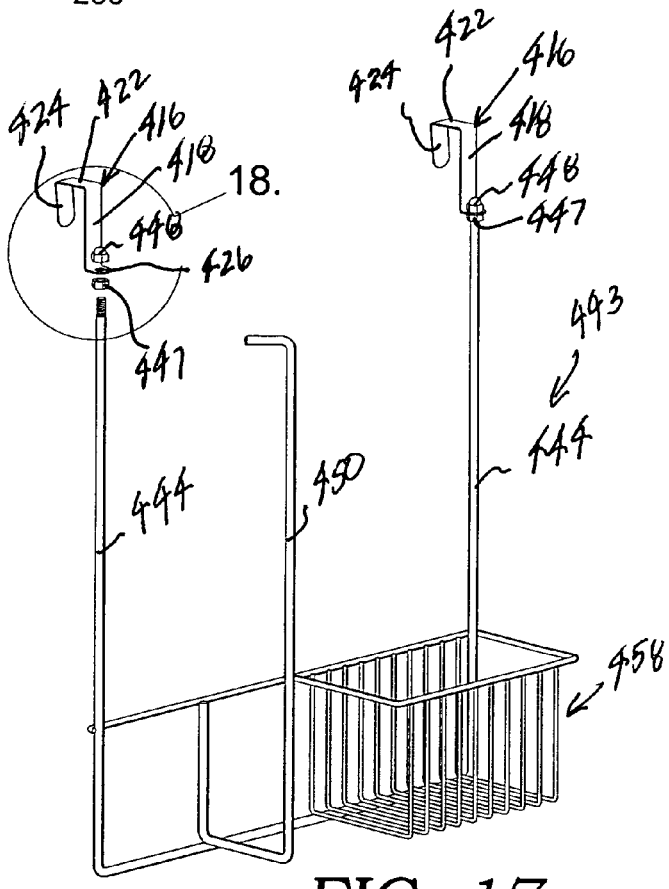
FIG. 17 is a perspective view of a storage rack which is connected with hanger brackets using a threaded connection in accordance with an additional alternative embodiment of the invention.

FIGS. 17 and 18 depict still another embodiment of a hanger bracket generally identified by numeral 416. The bracket 416 is for use with a flush type cabinet door and includes a vertical leg 418 having an L shaped hanger 420 on one end. The L-shaped hanger 420 includes a flat flange 422 which extends from the upper end of leg 418 and a tongue 424 extending from one end of flange 422 generally parallel to leg 418. Tongue 424 may converge slightly relative to leg 418 as it extends away from flange 422 to enhance the pressure of the bracket 416 when it is applied to the upper edge of a flush type cabinet door. The lower edge of tongue 424 is a free edge that may be rounded.

The leg 418 carries on its lower end a tab 426 that is bent perpendicular to leg 418. The tab 426 is rounded on its edge and is provided with an opening 428.

The brackets 416 are used in pairs to mount a storage device generally identified by numeral 443 (FIG. 17). The storage device 443 includes vertical hanger rods 444 that are threaded on their top ends at 446. Lock nuts 447 may be threaded onto the threaded ends 446. The ends 446 may then be extended through openings 428. Cap units 448 may be threaded onto the ends 446 to secure the storage device 443 to the brackets 416.

The L shaped hooks 420 may be installed closely on the top edge of a flush type cabinet door to mount the storage device 443 on the inside of the cabinet door. The storage device 443 may be virtually any type of device and may be similar to storage device 243 (FIG. 16) or devices 243*a* (FIG. 11) or 243*b* (FIG. 12), as well as other devices suitable for the storage of a wide variety of items. As shown in FIG. 17, the storage device 443 may have a paper towel rod 450 (similar to rod 250 shown in FIG. 16) and a wire basket 458 (similar to basket 258 shown in FIG. 16).

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. Storage apparatus for application to a door of a cabinet, said storage apparatus comprising:

a pair of hanger brackets adapted for application to an upper edge of the door to hang on the door and shaped to follow the contour of and mate with both a flush type cabinet door having an upper edge portion of substantially uniform thickness and a recessed type cabinet door having an upper edge formed in a stepped configuration with an upstanding lip adjacent to a ledge;

a connection portion of each bracket;

a storage device constructed to receive and hold articles; and a pair of hangers coupled with said storage device, said hangers having upper end portions applicable to said connection portions for hanging of said storage device on the inside of the door.

2. Storage apparatus as set forth in claim 1, wherein each of said hanger brackets comprises:

a main body having opposite first and second end portions;

a L shaped hanger on said first end portion of said main body for application to the upper edge portion of a flush type cabinet door to hang the bracket on the door; and a projection on said second end portion of said main body receiving said hangers to hang said storage device on said brackets.

3. Storage apparatus as set forth in claim 1, wherein each of said hanger brackets comprises a C shaped hanger applicable closely to said lip to hang the bracket from the door.

4. Storage apparatus as set forth in claim 3, wherein each of said hanger brackets comprises:

a main body having opposite first and second end portions, said C shaped hanger being on said first end portion; and a projection on said second end portion of said main body receiving said hangers to hang said storage device on said brackets.

5. Storage apparatus as set forth in claim 4, wherein said main body lies on said ledge.

6. Storage apparatus as set forth in claim 1, wherein:

each of said hanger brackets includes an L shaped hanger for application to the upper edge portion of a flush type door in a close fit thereon and a C shaped hanger for application to the upper edge of a recessed type door with said C shaped hanger fitting closely on said lip.

7. Storage apparatus as set forth in claim 6, wherein:

each of said hanger brackets includes a main body connecting said L-shaped hanger and said C shaped hanger; and a portion of said main body adjacent to said C shaped hanger lies substantially flatly on said ledge when said C shaped hanger is applied to said lip.

8. Storage apparatus as set forth in claim 6, wherein said L shaped bracket includes a tongue having an opening and each of said hangers coupled with said storage device includes a hook for insertion through said opening.

9. Storage apparatus as set forth in claim 6, wherein said C shaped bracket includes an arm and a tab connected by a flange and said arm has an opening and each of said hangers coupled with said storage device includes a hook for insertion through said opening.

10. Storage apparatus as set forth in claim 9, wherein said tab presents an opening aligned with said opening in said arm for receiving said hook.

11. Storage apparatus as set forth in claim 1, wherein said storage device comprises a substantially vertical rod for holding a roll of paper towels.

12. Storage apparatus as set forth in claim 11, wherein said storage device comprises a basket located to one side of said vertical rod.

13. In combination with a door of a cabinet, an improved hanger bracket comprising:

a main body having opposite first and second end portions;

an L shaped hanger on said first end portion of said main body applicable to an upper edge of the door, said L shaped hanger having a flange for spanning said upper edge and a tongue for application to an outside surface of the door;

a C shaped hanger on said second end portion of said main body applicable to an upper edge of the door when said upper edge has an upstanding lip thereon, said C shaped hanger having a flange for spanning said lip and a tab and an arm for application to respective inside and outside surfaces of said lip;

an opening in said L shaped hanger for receiving a hanger for a storage device when said C shaped hanger is applied to said lip; and an opening in said C shaped hanger for receiving a hanger for a storage device when said L shaped hanger is applied to said upper edge of the door.

14. A hanger bracket for mounting a storage device on a flush type cabinet door having an upper edge portion of substantially uniform thickness and on a recessed type cabinet door having an upper edge formed in a stepped configuration with an upstanding lip adjacent to a ledge, said bracket comprising:

a main body having opposite first and second end portions;

an L shaped hanger on said first end portion applicable to the upper edge portion of a flush type cabinet door, said L shaped hanger having a flange for spanning said upper edge portion;

a C shaped-hanger on said second end portion applicable to the lip on the upper edge of a recessed type cabinet door, said C shaped hanger having a flange for spanning said lip and a tab and an arm for application to respective inside and outside surfaces of said lip;

said C shaped hanger being constructed and arranged to receive the storage device when said L shaped hanger is applied to the upper edge portion of a flush type cabinet door; and said L shaped hanger being constructed and arranged to receive the storage device when said C shaped hanger is applied to the lip on the upper edge of a recessed type cabinet door.

15. Apparatus for storing articles in cabinets that have doors that may be either flush type with a uniform thickness upper edge portion or recessed type with a stepped configuration presenting an upstanding lip on an upper edge of the recessed type door, said apparatus comprising:

a hanger bracket having first and second ends and an L shaped hanger on said first end adapted for detachable application to said upper edge portion of a flush type door to hang said bracket thereon;

a C shaped hanger on said second end of the bracket adapted for detachable application to the lip of a recessed type door;

a storage device for storing articles; and a hanger extending from said storage device and providing an attachment for hanging said storage device from said bracket when said L shaped hanger is applied to said upper edge portion of a flush type door and when said C shaped hanger is applied to the lip of a recessed type door.

16. Apparatus as set forth in claim 15, wherein:

said attachment includes a hook on said hanger extending from said storage device;

said C shaped hanger has an opening for receiving said hook to hang said storage device from said bracket; and said L shaped hanger has an opening for receiving said hook to hang said storage device from said bracket.

* * * * *